US011150036B2

(12) United States Patent
Badin et al.

(10) Patent No.: US 11,150,036 B2
(45) Date of Patent: Oct. 19, 2021

(54) INDUCED DRAFT AIR-COOLED CONDENSER

(71) Applicant: SPX Dry Cooling Belgium, Brussels (BE)

(72) Inventors: Francis Badin, Binche (BE); Christophe Deleplanque, Brussels (BE); Michel Vouche, Marbais (BE)

(73) Assignee: SPG Dry Cooling Belgium, Brussels (BE)

( * ) Notice: Subject to any disclaimer, the term of this patent is extended or adjusted under 35 U.S.C. 154(b) by 241 days.

(21) Appl. No.: 16/327,423

(22) PCT Filed: Aug. 23, 2017

(86) PCT No.: PCT/EP2017/071229

§ 371 (c)(1),
(2) Date: Feb. 22, 2019

(87) PCT Pub. No.: WO2018/037043

PCT Pub. Date: Mar. 1, 2018

(65) Prior Publication Data

US 2019/0242660 A1 Aug. 8, 2019

(30) Foreign Application Priority Data

Aug. 24, 2016 (EP) ..... 16185543

(51) Int. Cl.
*F28F 9/013* (2006.01)
*F28B 1/06* (2006.01)
(Continued)

(52) U.S. Cl.
CPC ..... *F28F 9/013* (2013.01); *F28B 1/06* (2013.01); *F28B 9/00* (2013.01); *F28B 9/08* (2013.01); *F28F 9/007* (2013.01); *F25B 39/04* (2013.01)

(58) Field of Classification Search
CPC ..... F28B 1/06; F28B 2001/065; F28B 7/00; F28B 9/00; F28B 9/02; F28B 9/08;
(Continued)

(56) References Cited

U.S. PATENT DOCUMENTS 3,185,213 A 5/1965 Waternberg
3,223,152 A * 12/1965 Schulenberg ..... F28B 1/06 165/146

(Continued)

FOREIGN PATENT DOCUMENTS

EP 1577626 A1 * 9/2005 ..... F28B 1/06
EP 1901019 A2 * 3/2008 ..... F28B 1/06

(Continued)

OTHER PUBLICATIONS

EP-1577626-A1—English machine translation.pdf (Year: 2005).*

(Continued)

*Primary Examiner* — Jianying C Atkisson
*Assistant Examiner* — Jose O Class-Quinones
(74) *Attorney, Agent, or Firm* — Hanley, Flight & Zimmerman, LLC

(57) ABSTRACT

Air-cooled condensers and air-cooled condenser streets for condensing exhaust steam from a turbine are disclosed. An example air-cooled condenser street includes one or more rows of V-shaped heat exchangers. Each row includes a main steam manifold to introduce exhaust steam into tube bundles that are placed in an inclined position such that condensate formed in the bundles flows back by gravitation to the main steam manifold. Top steam manifolds are connected to the upper end of respectively each of the tube bundles of the air-cooled condenser street. The series of parallel top steam manifolds are forming a support assembly
(Continued)

for supporting one or more fan decks. The fan decks support a plurality of fans to induce an air draft in the V-shaped heat exchangers.

14 Claims, 15 Drawing Sheets

(51) Int. Cl.
*F28F 9/007* (2006.01)
*F28B 9/00* (2006.01)
*F28B 9/08* (2006.01)
*F25B 39/04* (2006.01)

(58) Field of Classification Search
CPC ..... F28B 9/10; F25B 39/04; F25B 2339/04; F28D 2021/0063
See application file for complete search history.

(56) References Cited

U.S. PATENT DOCUMENTS 3,289,742 A * 12/1966 Niemann ..... F28B 11/00 165/111
3,384,165 A * 5/1968 Mathews ..... F28F 9/0136 165/122
3,707,185 A 12/1972 Modine et al.
3,814,177 A * 6/1974 Harris ..... F28B 1/06 165/110
3,976,127 A * 8/1976 Harris ..... F28B 9/06 165/125
4,149,588 A * 4/1979 Waters ..... F28D 15/0275 165/11.1
4,226,282 A * 10/1980 Kunsagi ..... F28D 15/0275 165/104.14
4,308,913 A * 1/1982 Heeren ..... F28F 9/013 165/68
5,765,629 A * 6/1998 Goldsmith ..... F28B 9/10 165/112
5,950,717 A * 9/1999 Fay ..... F28B 1/06 165/111
5,954,123 A * 9/1999 Richardson ..... F28F 9/001 165/149
6,382,310 B1 * 5/2002 Smith ..... F28B 1/06 165/121
6,474,272 B2 * 11/2002 Bensing ..... B01D 5/0012 122/459
8,302,670 B2 * 11/2012 Yang ..... F28F 13/06 165/67
9,995,182 B2 * 6/2018 Scholz ..... F28B 1/06
2005/0167093 A1 * 8/2005 Schaefer ..... F28B 1/06 165/300
2006/0860902 4/2006 Fay
2009/0220334 A1 * 9/2009 Vouche ..... F04D 29/664 415/119
2010/0263840 A1 * 10/2010 Nobel ..... F28F 1/126 165/120
2011/0066298 A1 * 3/2011 Francino ..... F01K 13/02 700/290
2013/0292103 A1 * 11/2013 Eindhoven ..... B23P 15/26 165/173
2014/0251589 A1 * 9/2014 Vouche ..... F28B 1/06 165/281
2015/0377559 A1 * 12/2015 Csaba ..... F28F 9/013 165/143
2019/0093953 A1 * 3/2019 Singh ..... F28D 1/05308

FOREIGN PATENT DOCUMENTS

EP 2413078 A1 * 2/2012 ..... F28B 11/00
FR 1249717 A * 12/1960 ..... F28B 1/06
GB 968430 A * 9/1964 ..... F28B 1/06
WO WO-2016050228 A1 * 4/2016 ..... F01K 9/003

OTHER PUBLICATIONS

FR-1249717-A—English machine translation.pdf (Year: 1960).*
Spencer—NPL—Specifying Steam Surface Condensers.pdf (Year: 2015).*
International Searching Authority, "Search Report," issued in connection with PCT/EP2017/071229, dated Nov. 17, 2017, 3 pages.
International Searching Authority, "Writen Opinion," issued in connection with PCT/EP2017/071229, dated Nov. 17, 2017, 6 pages.

* cited by examiner

INDUCED DRAFT AIR-COOLED CONDENSER

RELATED APPLICATIONS

This patent arises from the U.S. national stage of International Patent Application Serial No. PCT/EP2017/071229, having an international filing date of Aug. 23, 2017, and claims benefit of European Patent Application No. 16185543.2, filed on Aug. 24, 2016, which are hereby incorporated by reference in their entireties for all purposes.

FIELD OF THE INVENTION

The invention is related to an air-cooled condenser street for condensing exhaust steam from a steam turbine of for example a power plant.

The invention is also related to an air-cooled condenser comprising one or more air-cooled condenser streets.

DESCRIPTION OF PRIOR ART

Various air-cooled condenser (ACC) types for condensing steam from a power plant are known in the art. These air-cooled condensers make use of heat exchangers which generally comprise a number of finned tubes arranged in parallel forming a tube bundle. The tubes of the tube bundle are in contact with the ambient air and when steam passes through the tubes, the steam gives off heat and is eventually condensed.

Typically, two tube bundles are placed in an inclined position with respect to a horizontal level. In this way, when condensate is formed in the tubes, it can flow by gravitation to the lower end section of the tubes where condensate is collected.

Depending on the arrangement of the two bundles of the heat exchanger, a so-called A-shape heat exchanger geometry or a V-shaped heat exchanger geometry can be obtained. For example, an air-cooled condenser having a V-shaped heat exchanger geometry is disclosed in U.S. Pat. No. 7,096,666, while an example of an A-type heat exchanger geometry is disclosed in U.S. Pat. No. 8,302,670.

Air-cooled condensers comprise one or more main steam manifolds that receive the exhaust steam from the steam turbine. Those main steam manifolds are configured to supply the steam to the various tubes of the tube bundles. Generally, the main steam manifold is extending in a direction parallel with a longitudinal axis Y perpendicular to the vertical axis Z and the main steam manifold is connected to one end of each tube of the bundles in order to introduce the steam in the bundles. For a V-shaped or A-shaped heat exchanger geometry, a single main steam manifold can be used to introduce steam to the two tube bundles of the V or A shaped heat exchanger.

Motorized fans located either below or above the two tube bundles generate, respectively, a forced air draft or an induced air draft through the heat exchangers. In order to have a sufficient air flow, the fans and bundles are placed at an elevation with respect to the floor level. Depending on the detailed design of the air-cooled condenser, elevations of for example 4 m to 20 m are required.

An air-cooled condenser is generally an assembly of so-called air-cooled condenser streets wherein each ACC street comprises a plurality of ACC modules. An ACC module is a part of an air-cooled condenser street that comprises components associated to a fan, including the fan with its motor, the fan supporting structure and the tube bundles. The ACC modules are placed in a row such that a main steam manifold can supply steam to the tube bundles of multiple modules. The multiple ACC modules placed in a row are forming an ACC street. One or more of these air-cooled condenser streets can be placed adjacently to each other for forming an air-cooled condenser.

An air-cooled condenser comprises various large frame structures to support the various components such as the tube bundles, the main steam manifolds, the condensate manifolds and the fans. Typically, as for example shown in U.S. Pat. No. 8,302,670, a lower support structure can be distinguished from an upper frame structure that is located on top of the lower support structure. The lower support structure comprises legs positioned on a floor level. As shown in U.S. Pat. No. 8,302,670, a fan deck configured to support the fans is located under the tube bundles and the fan deck is supported by the lower frame structure. The upper frame structure provides an overall structural support to the area of the heat exchanger elements so as to provide support elements for the main steam manifold and support elements for the tube bundles. In addition, so-called wind walls comprising auxiliary support structures are attached to the upper frame structure. The wind walls are necessary to minimize recirculation of heated air. Generally, additional support structures are provided to allow access for maintenance activities.

A further example of a lower frame structure is disclosed in US2010/0147487A1, illustrating the complexity of the steel structure needed for an air-cooled condenser.

A disadvantage of this type of air-cooled condensers is that large quantities of steel are needed to construct the various support structures, which increases the overall cost of the air-cooled condenser.

Another disadvantage is that, in order to erect the air-cooled condenser, a lot of time and labor consuming work, including various on-site welding activities, are required.

SUMMARY OF THE INVENTION

It is an object of the present invention to provide an air-cooled condenser street requiring a lower overall amount of material (such as steel and/or concrete for example) for building the supporting frame structure(s).

Another object of the present invention is to provide an air-cooled condenser street which is cheaper to erect at the site of installation.

A further object is to provide an air-cooled condenser that has an easy access to perform maintenance activities.

These objects and other aspects of the invention are achieved with the air-cooled condenser street and air-cooled condenser as claimed.

According to a first aspect of the invention an air-cooled condenser street for condensing exhaust steam from a turbine is provided. Such an air-cooled condenser street comprises a single-row or a series of adjacent rows V(i) of V-shaped heat exchangers, with i=1 to NV and NV≥1, NV being the number of rows of V-shaped heat exchangers. The single-row or each row of the series of adjacent rows comprises:

one or more first tube bundles inclined with an angle $-\delta 1$ with respect to a vertical plane (Z-Y), formed by a vertical axis Z and a longitudinal axis Y perpendicular to the vertical axis Z, with $15° < \delta 1 < 90°$, one or more second tube bundles inclined with an angle $+\delta 2$ with respect to the vertical plane, with $15° < \delta 2 < 90°$, and wherein said first and second tube bundles have lower and an upper ends, and a main steam manifold for supplying the exhaust steam to the first and second tube bundles, the main steam manifold is extending in a direction parallel with the longitudinal axis Y and is positioned at a vertical position z1 with respect to the vertical axis Z and positioned at a lateral position x(i) with respect to a lateral axis X perpendicular to the axes Z and Y, and wherein the main steam manifold is connected to the lower ends of the first and second tube bundles.

The air-cooled condenser street comprises one or more fans for inducing an air draft through the single row or the series of adjacent rows of V-shaped heat exchangers.

The air-cooled condenser street further comprises a series of parallel top steam manifolds RM(j) for collecting and transporting non-condensable gases and/or steam that is not condensed in the first or second tube bundles, with j=1 to NRM and (NV+1)≤NRM≤(2*NV), and with NRM being the number of parallel top steam manifolds. Each top steam manifold RM(j) of the series of parallel top steam manifolds is extending in a direction parallel with the longitudinal axis Y. The air-cooled condenser street is configured such that each tube bundle of the first and second tube bundles of the single-row or the series of adjacent rows is connected with its upper ends with a top steam manifold of the series of parallel top steam manifolds RM(j).

The air-cooled condenser further comprises one or more fan support assemblies for supporting the one or more fans, and wherein each fan support assembly comprises a fan deck configured for bridging the series of parallel top steam manifolds RM(j) in the direction of the lateral axis X, and wherein the fan deck is coupled to the series of parallel top steam manifolds RM(j).

Advantageously, by connecting parallel top steam manifolds to the upper ends of the tube bundles of the single row of the series of adjacent rows of V-shaped heat exchangers and by coupling the fan deck to the top steam manifolds, there is no need to build an upper frame structure to support the fan decks.

Advantageously, by placing the tube bundles in a V-shaped arrangement where the large main steam manifold is positioned in the vertex region of the V-shaped heat exchanger and by coupling the fan deck to the parallel top steam manifolds, a rigid self-supporting structure is obtained for supporting the weight of the fan, the fan motor and mechanical drives.

Advantageously, by coupling the fan deck to the parallel top steam manifolds, stability is provided to the V-shaped heat exchangers having tube bundles connected with their lower ends to a main steam manifold. Especially, stability is provided to the external tube bundles.

Advantageously, the air-cooled condenser street and the air-cooled condenser can make use of simplified lower level support structures to elevate the main steam manifolds from a ground floor. In view of the geometry of the air-cooled condenser street of the invention, a support structure that elevates the main steam manifolds will at the same time also elevate the tube bundles, the parallel top steam manifolds and the fan deck with the fans. In contrast to prior art configurations where multiple support structures are needed to support these various components of the air-cooled condenser.

Advantageously, by using an air-cooled condenser according to the invention, the amount of steel needed for building the support structures can drastically be reduced.

Advantageously, by using a fan deck, the access to the fans to perform maintenance activities can be facilitated.

Advantageously, as the overall number of support structures to be installed can be reduced, the time and effort to erect the air-cooled condenser is reduced.

Advantageously, by placing one fan deck on top of one or multiple rows of V-shaped heat exchangers, the number of components needed to erect the condenser is reduced.

In embodiments, the air-cooled condenser street comprises one or more guiding elements located between the series of parallel top steam manifolds RM(j) and the fan decks of the one or more fan assemblies. The one or more guiding elements are configured to allow a differential thermal expansion between the fan deck and the top steam manifolds RM(j).

Preferably, the number NV of rows of V-shaped heat exchangers is in the range 1≤NV≤6.

According to a further aspect of the invention, an air-cooled condenser is provided comprising one or more air-cooled condenser streets and a support structure configured for elevating the main steam manifolds of each of the one or more air-cooled condenser streets at a height H1>4 m with respect to a ground floor and wherein H1 is measured along the vertical axis Z.

SHORT DESCRIPTION OF THE DRAWINGS

These and further aspects of the invention will be explained in greater detail by way of example and with reference to the accompanying drawings in which.

Figure 7A:
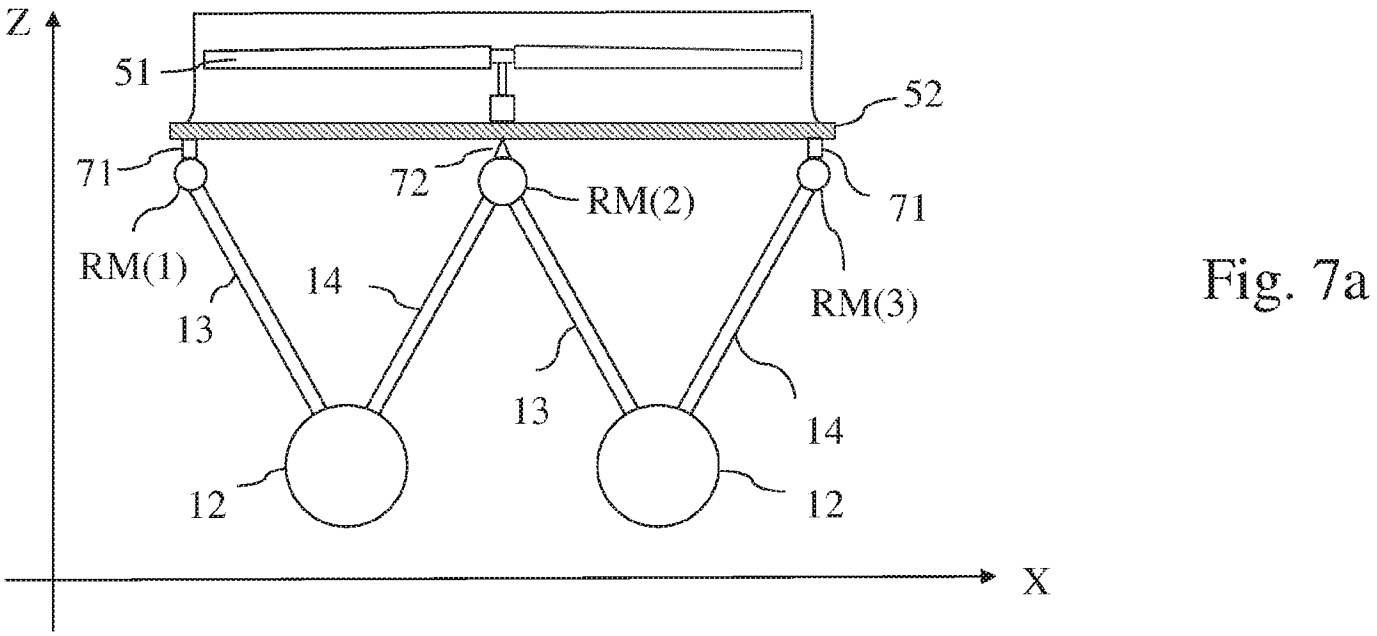
Figure 7B:
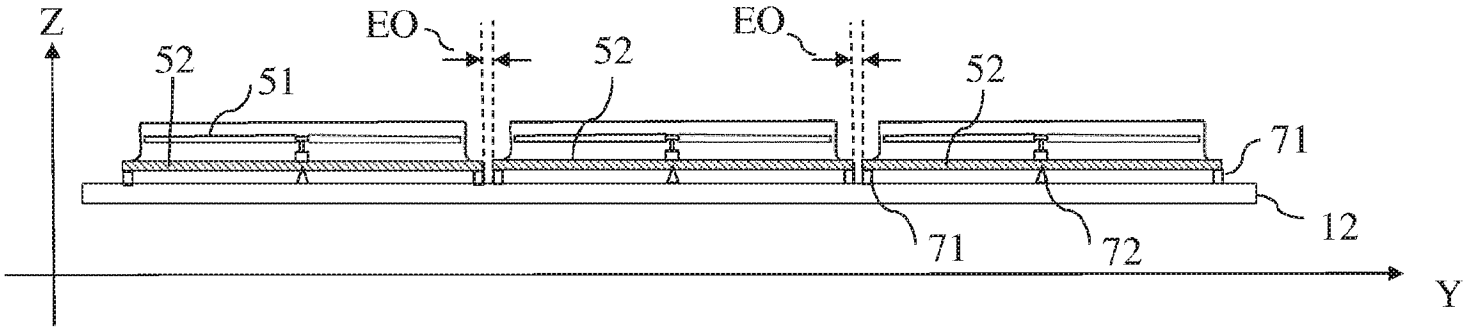
Figure 8:
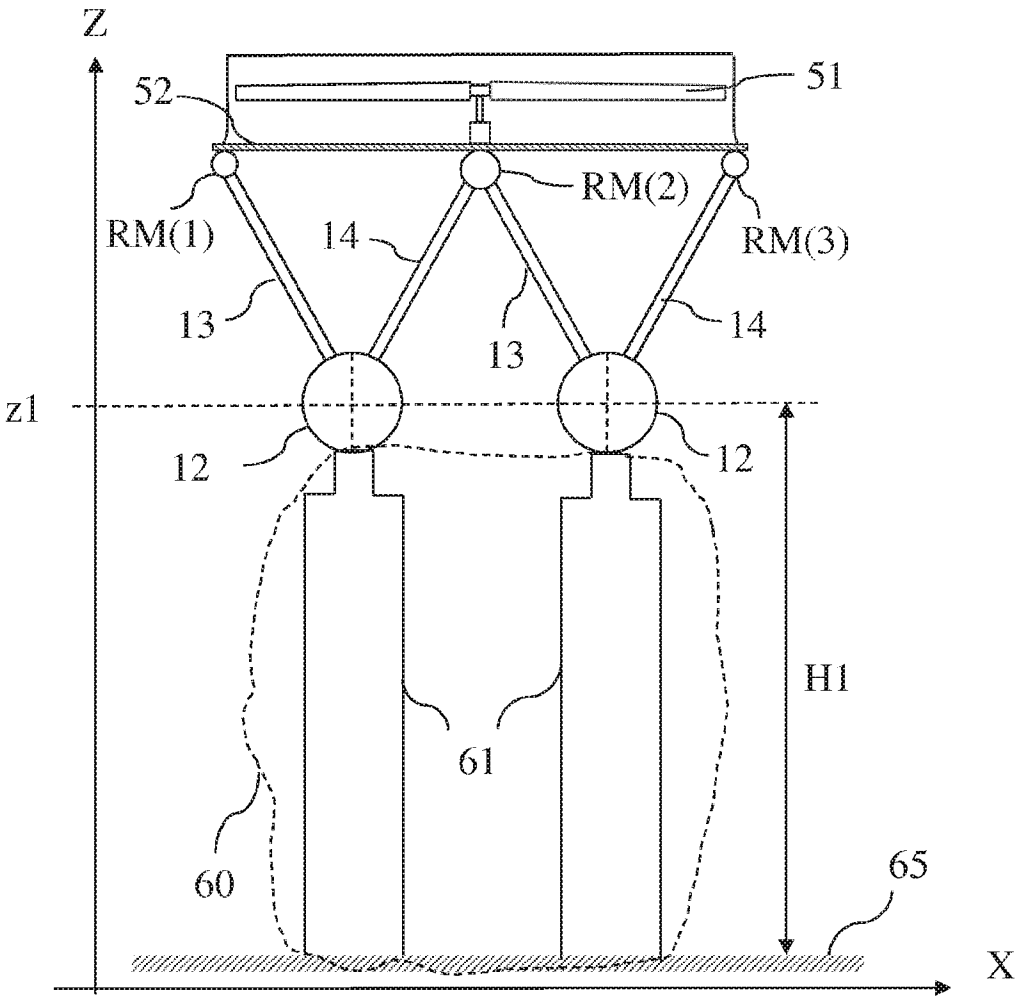
Figure 9:
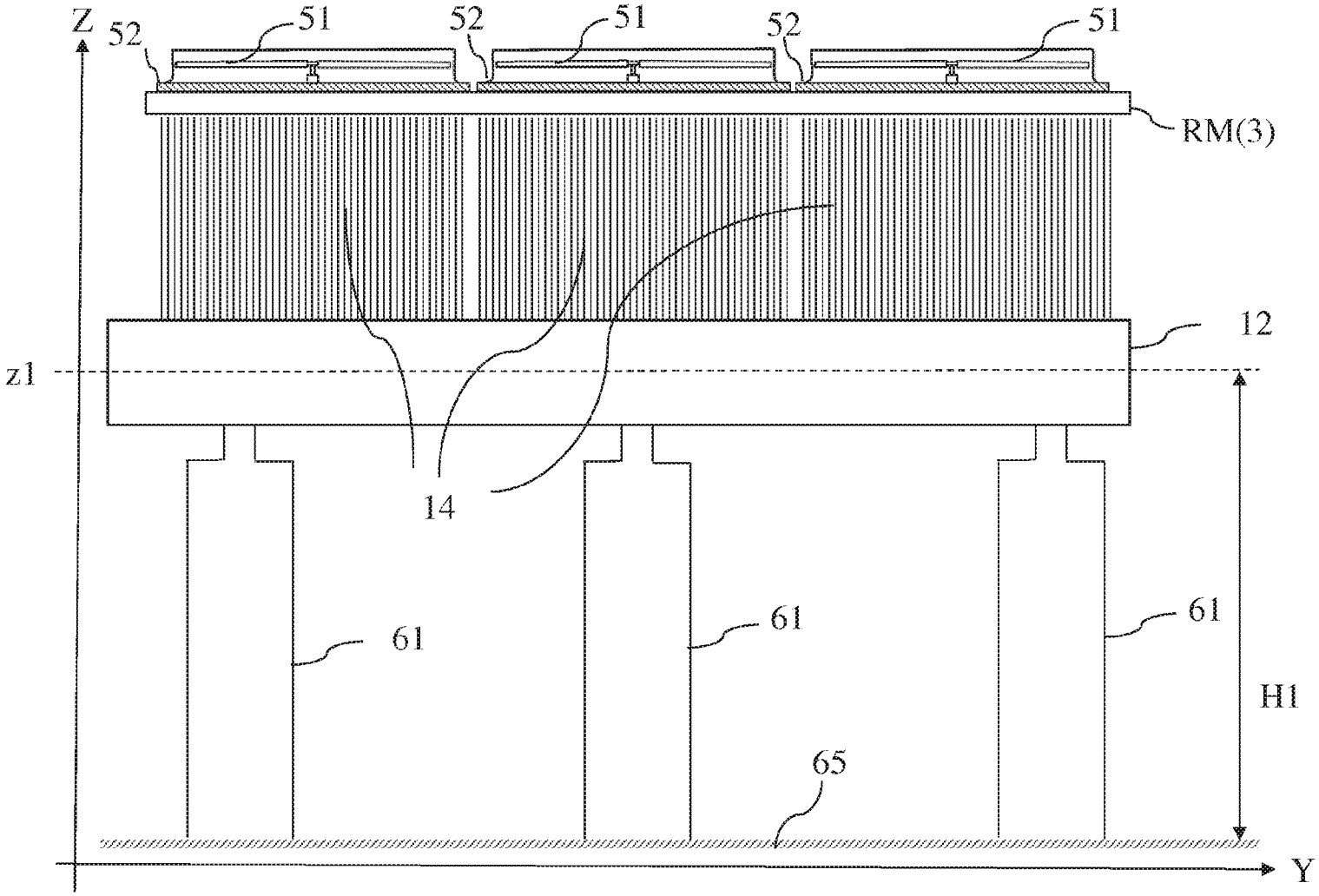
Figure 10:
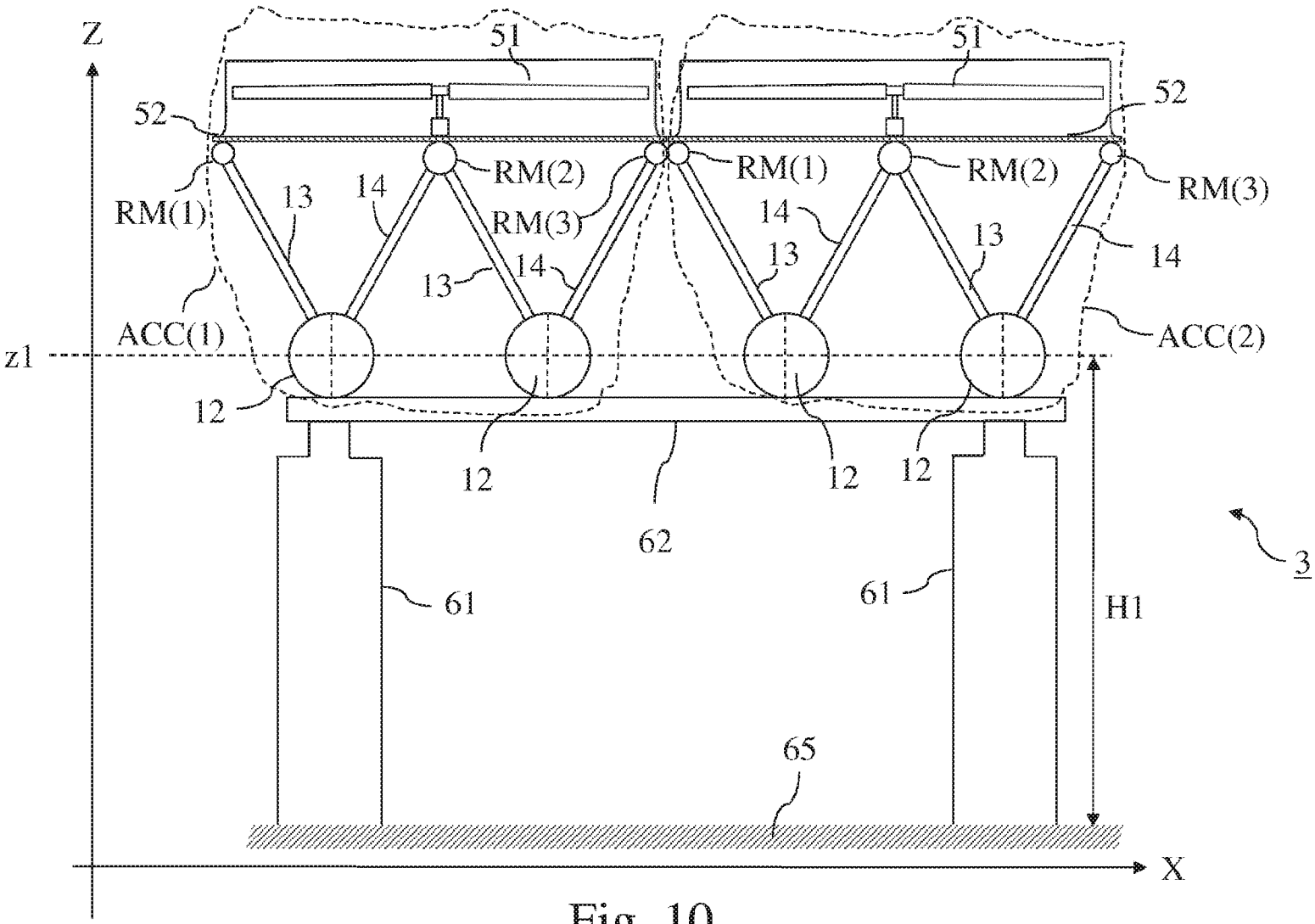
Figure 11:
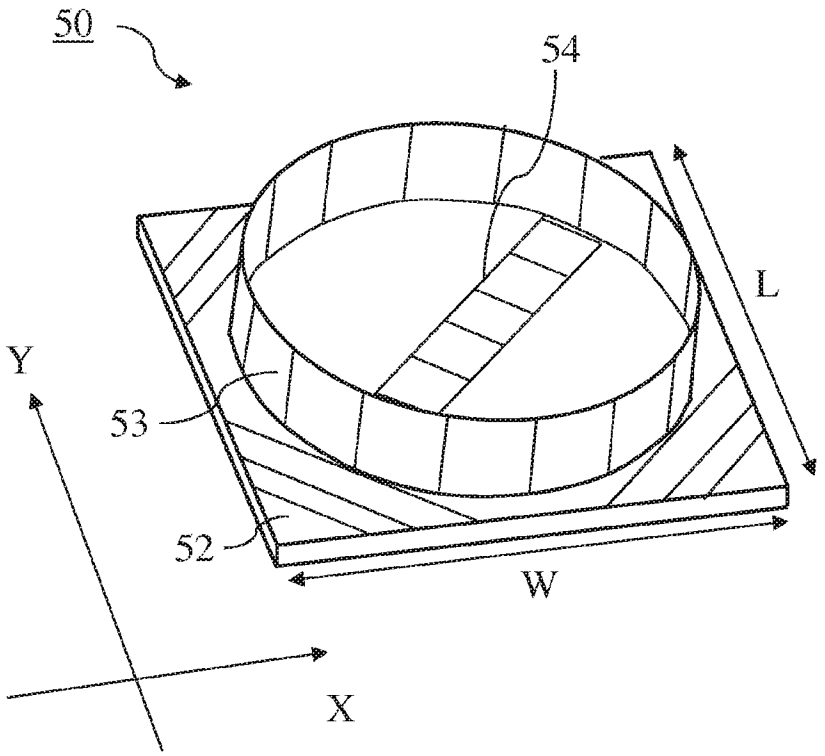
Figure 12:
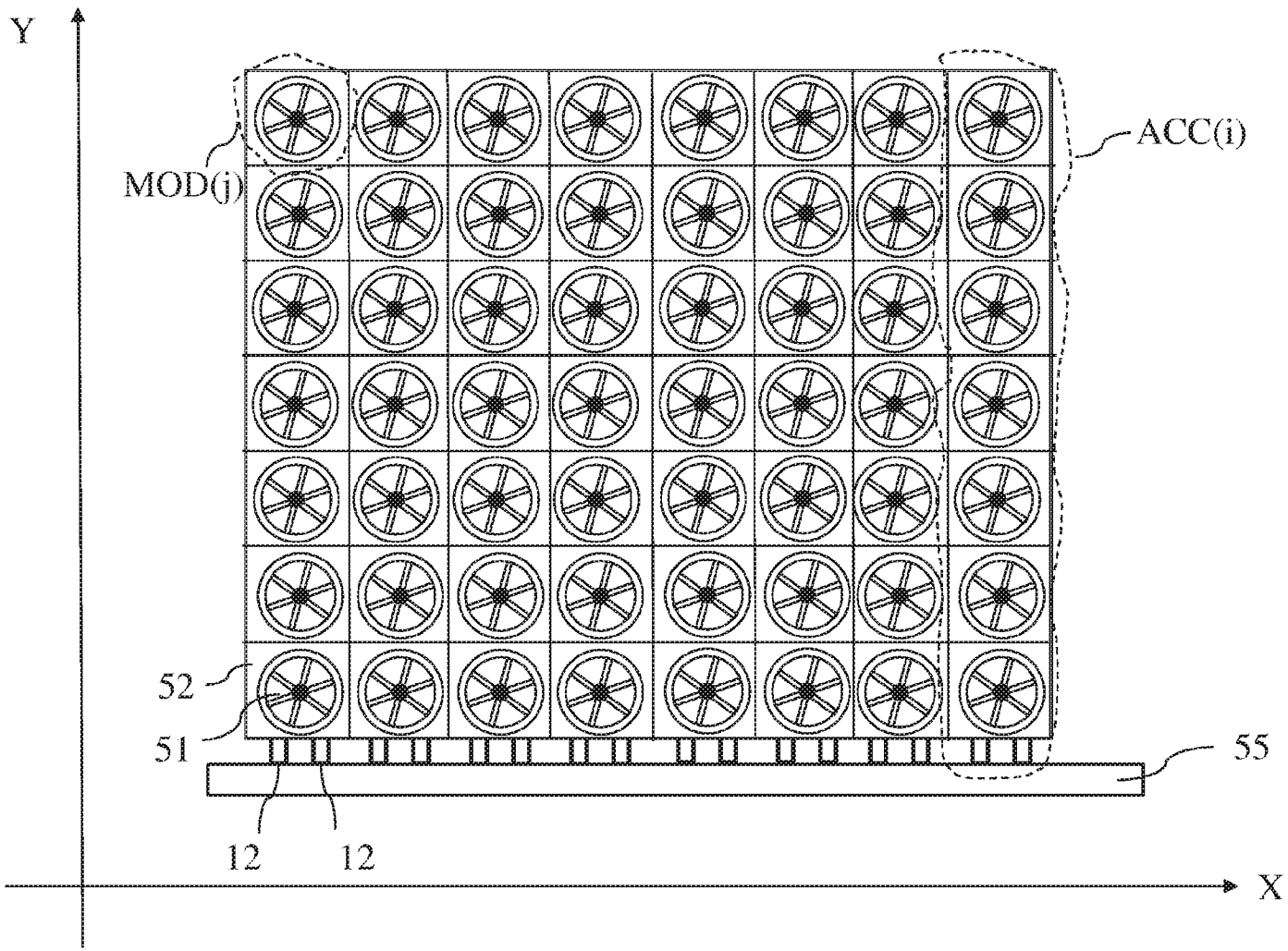
Figure 13B:
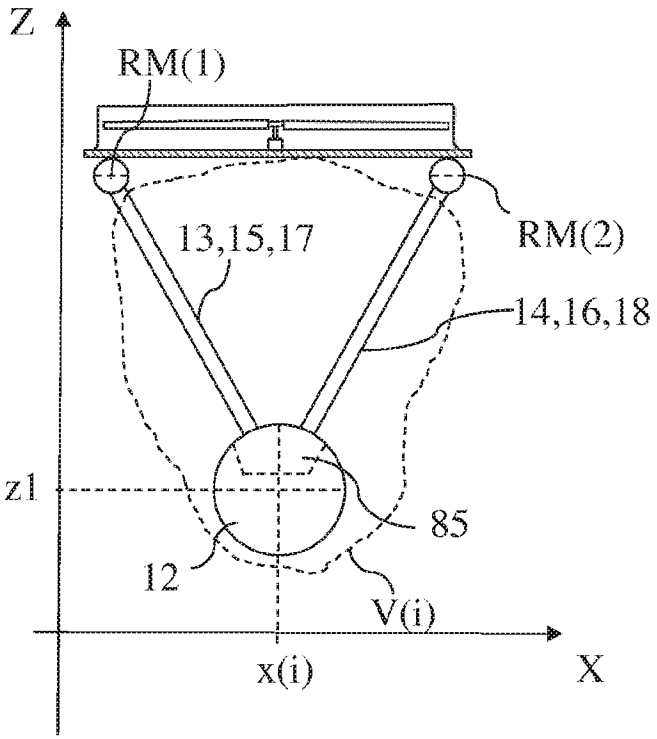
Figure 13A:
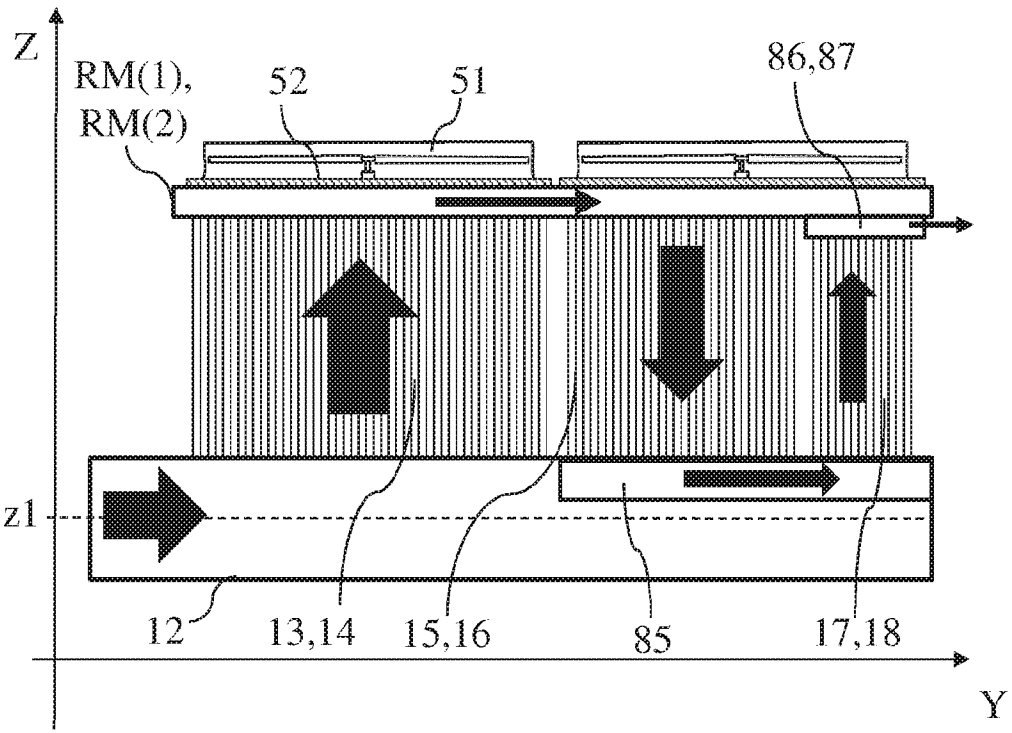

FIG. 7*a* and FIG. 7*b* schematically illustrate the interface elements located between the fan deck and the parallel top steam manifolds, FIG. 8 shows a front view of an air cooled condenser street elevated by a support structure;

FIG. 9 shows a side view of an air cooled condenser street supported by a support structure;

FIG. 10 shows a cross section of an air-cooled condenser comprising two air-cooled condenser streets ACC(1) and ACC(2), supported by a common support structure;

FIG. 11 shows a perspective view of an example of a fan support assembly according to the invention;

FIG. 12 shows a top view of an air-cooled condenser comprising eight air-cooled condenser streets ACC(i) and wherein each air-cooled condenser street comprises 7 ACC modules MOD(j);

FIG. 13*a* shows a side view of an air-cooled condenser street comprising two ACC modules with primary, secondary and tertiary tube bundles;

FIG. 13*b* shows a front view of the air-cooled condenser street shown in FIG. 13*a;*

Figure 14:
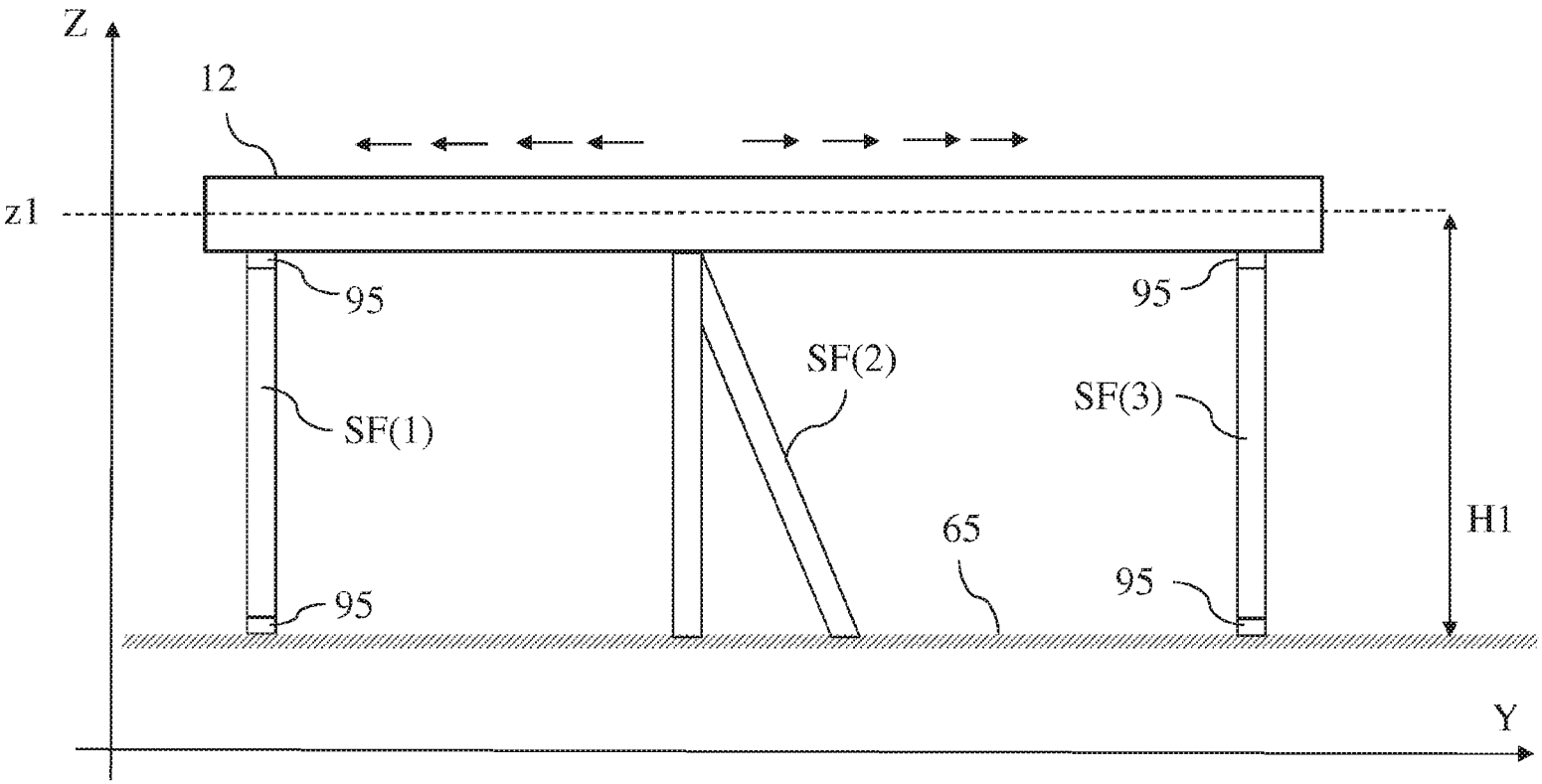
Figure 15:
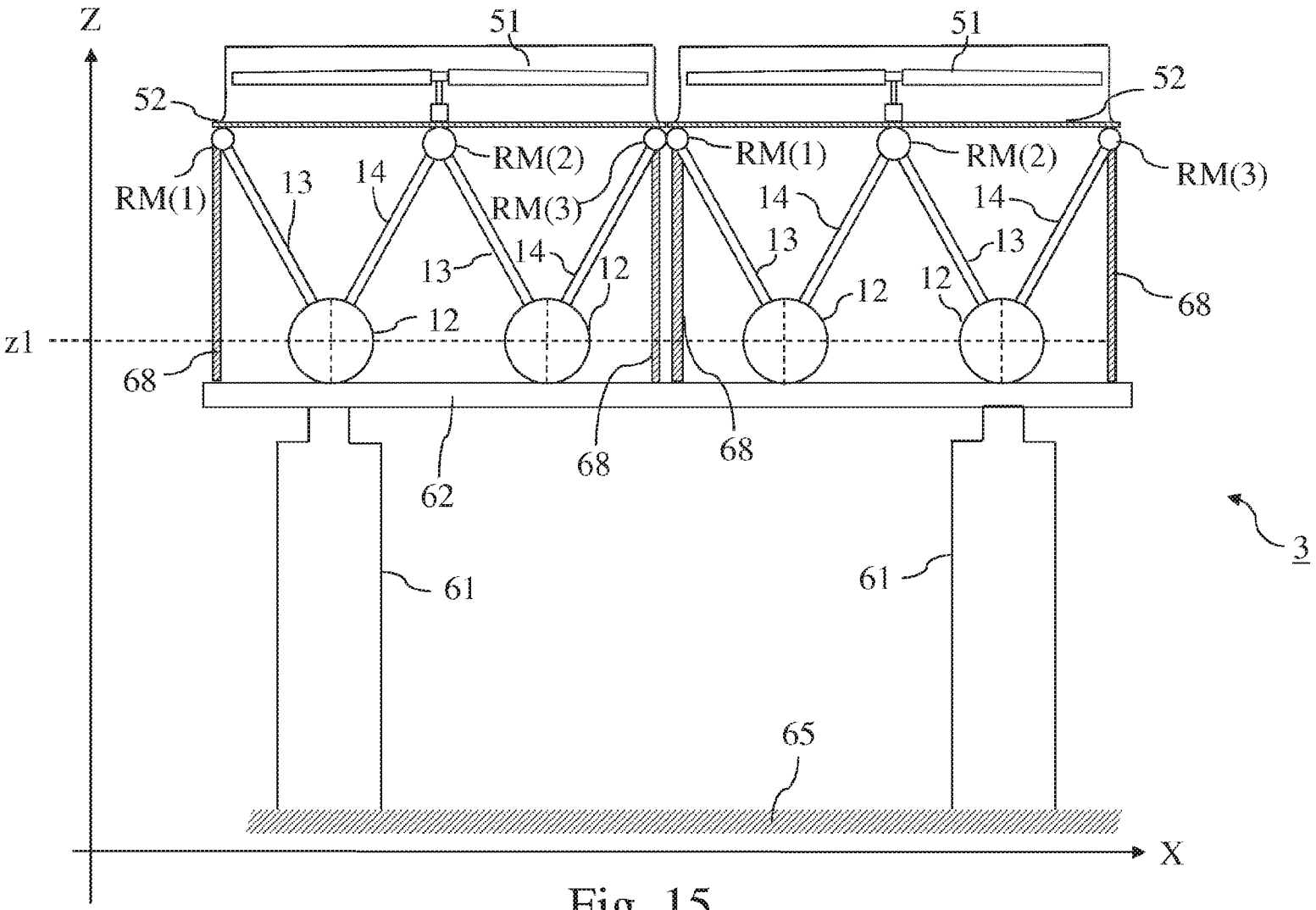

FIG. 14 shows a side view of an example of a support structure supporting main steam manifolds;

FIG. 15 shows another example of an air-cooled condenser comprising two air-cooled condenser streets according to the invention.

The figures are not drawn to scale. Generally, identical components are denoted by the same reference numerals in the figures.

According to a first aspect of the invention, an air-cooled condenser street for condensing an exhaust steam flow from a steam turbine is provided.

Figure 1:
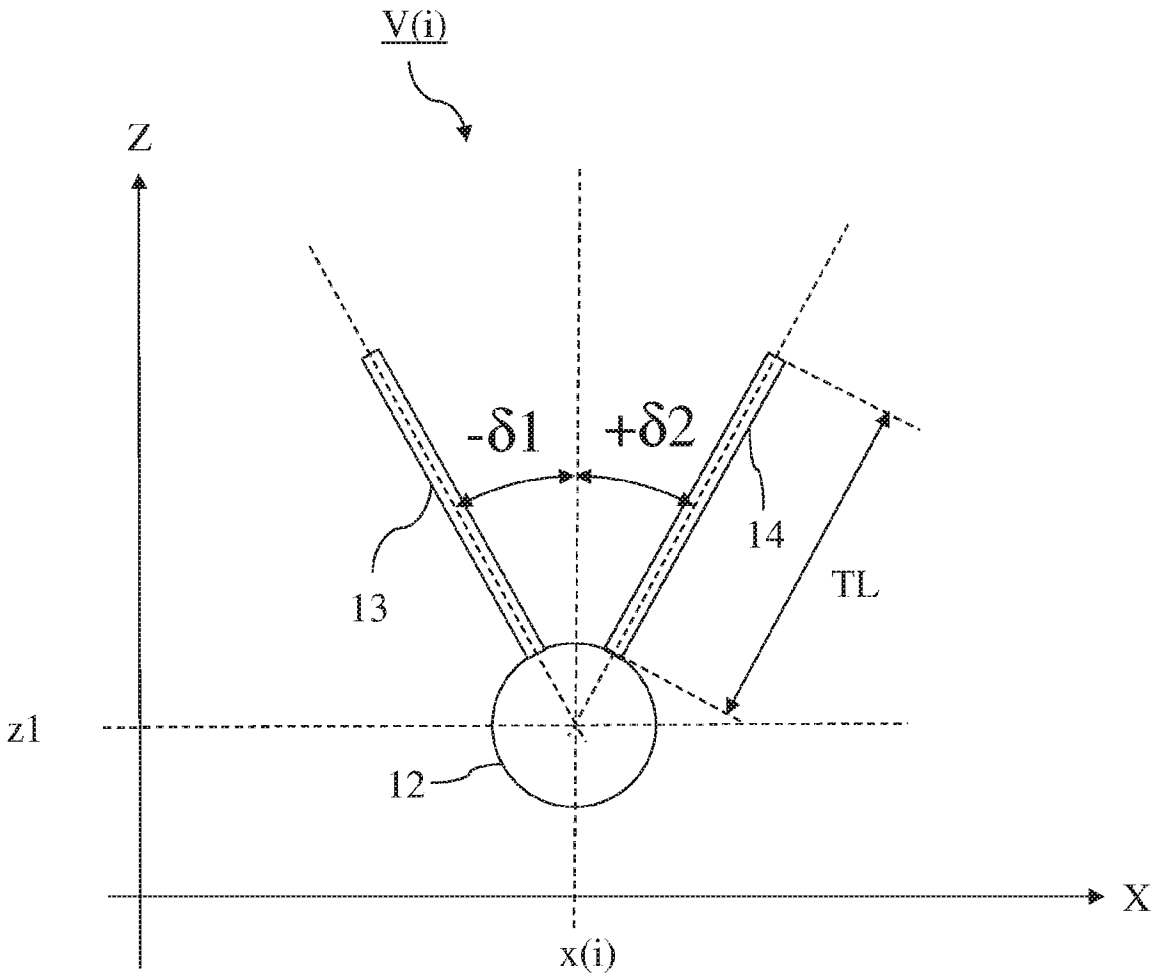
FIG. 1 shows a pair of tube bundles connected with their lower ends to a main steam manifold forming a V-shaped heat exchanger row V(i)
Figure 2:
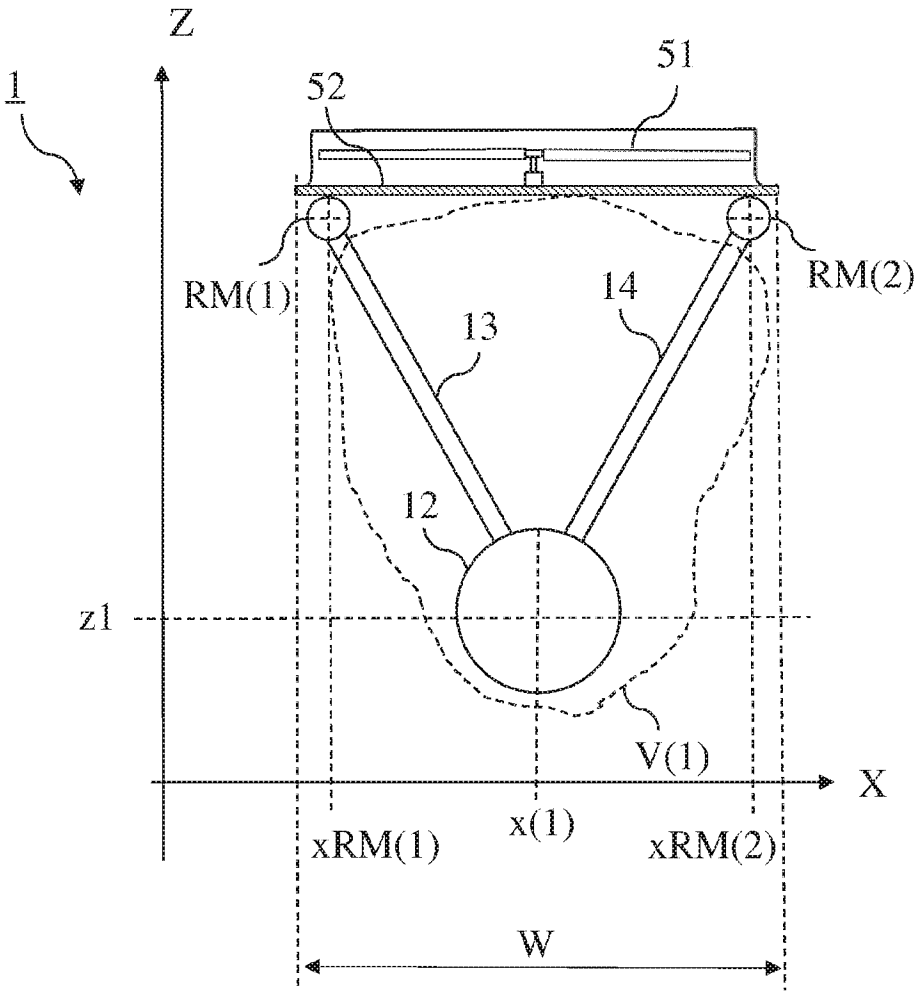
FIG. 2 shows a cross section on air-cooled condenser street according to the invention comprising a single-row V-shaped heat exchanger V(1)
Figure 3:
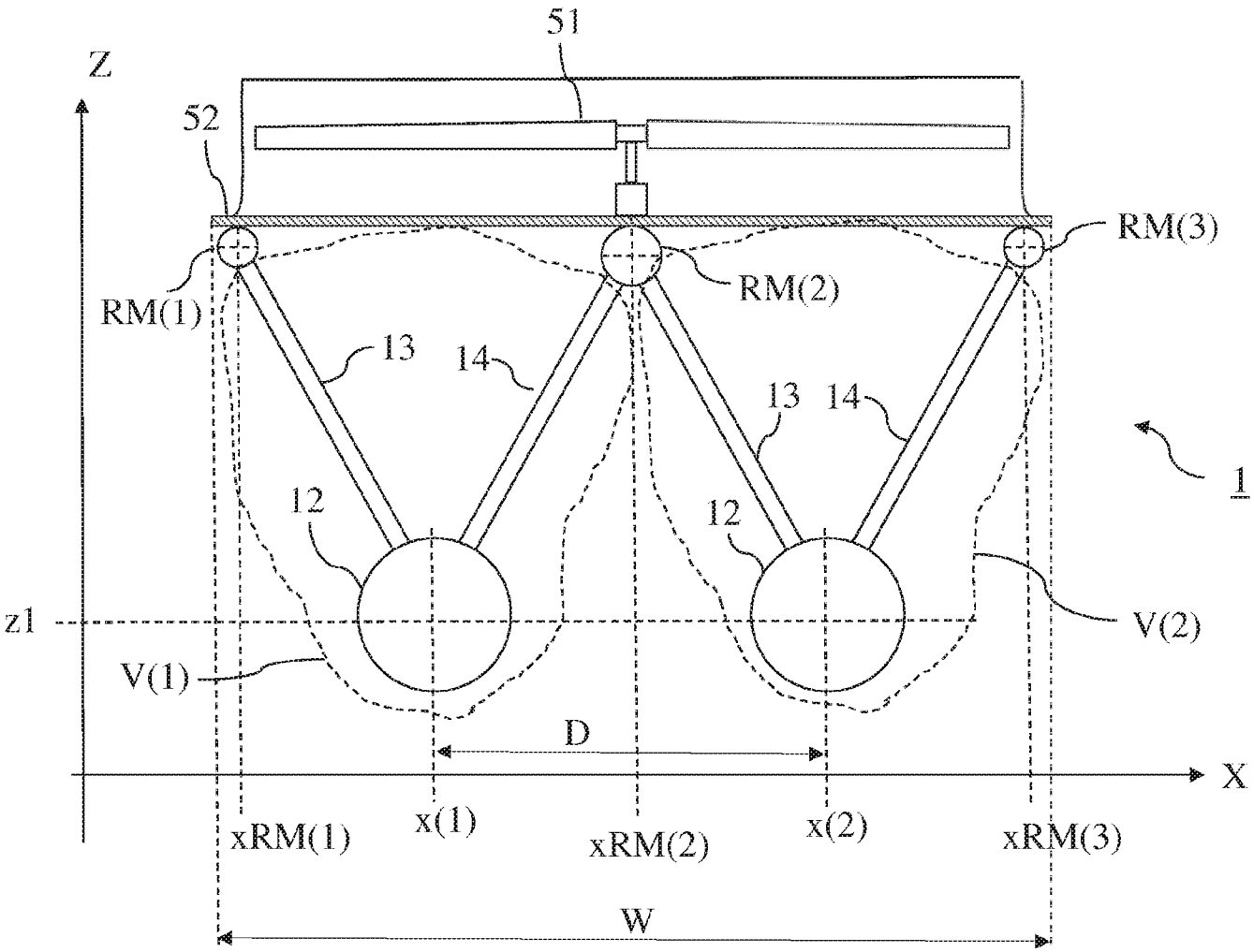
FIG. 3 shows a cross section of an air-cooled condenser street according to the invention comprising two rows V(1) and V(2) of V-shaped heat exchangers.
Figure 4:
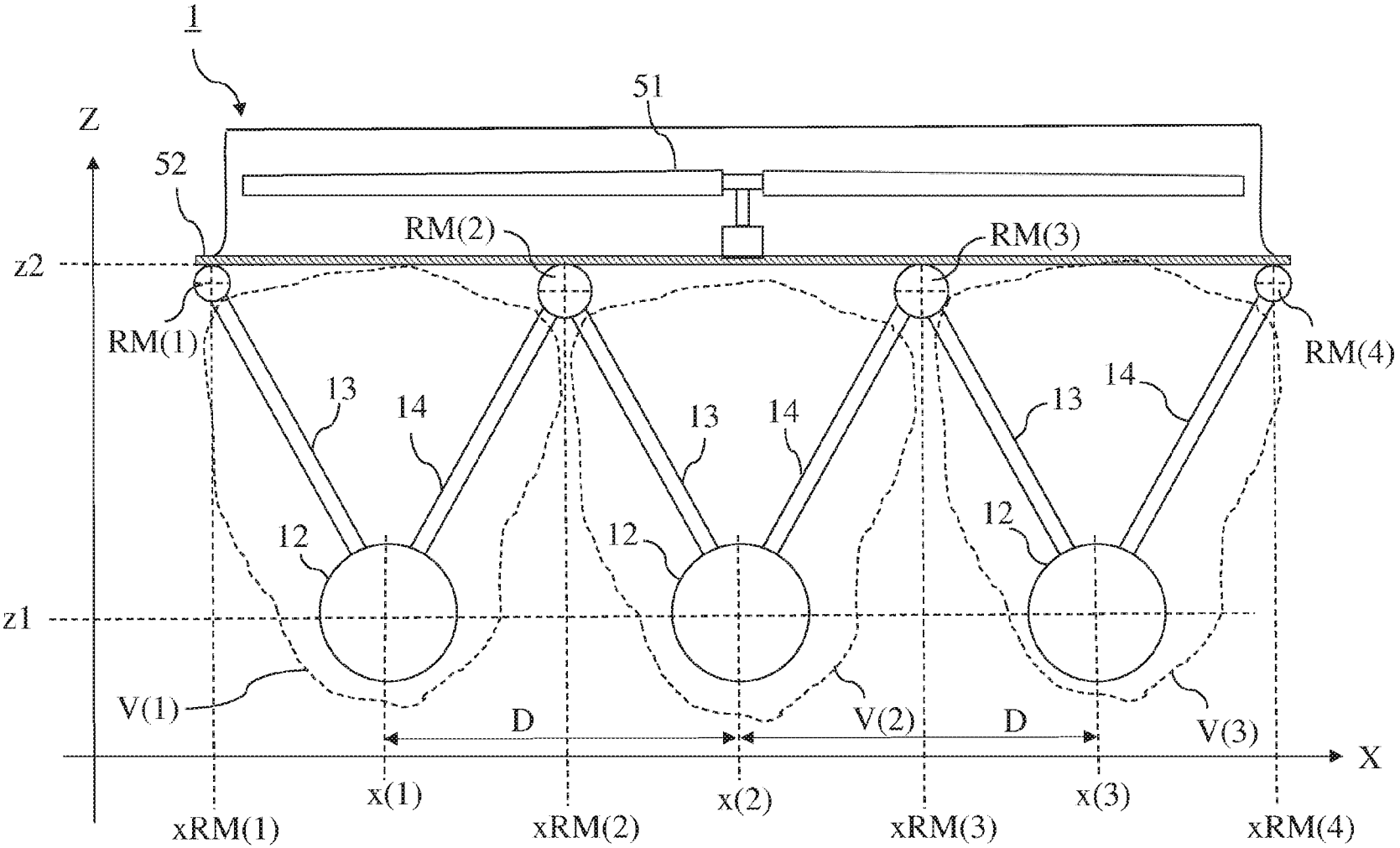
FIG. 4 shows a cross section of an air-cooled condenser street according to the invention comprising three rows of V-shaped heat exchangers: V(1), V(2) and V(3)
Figure 5:
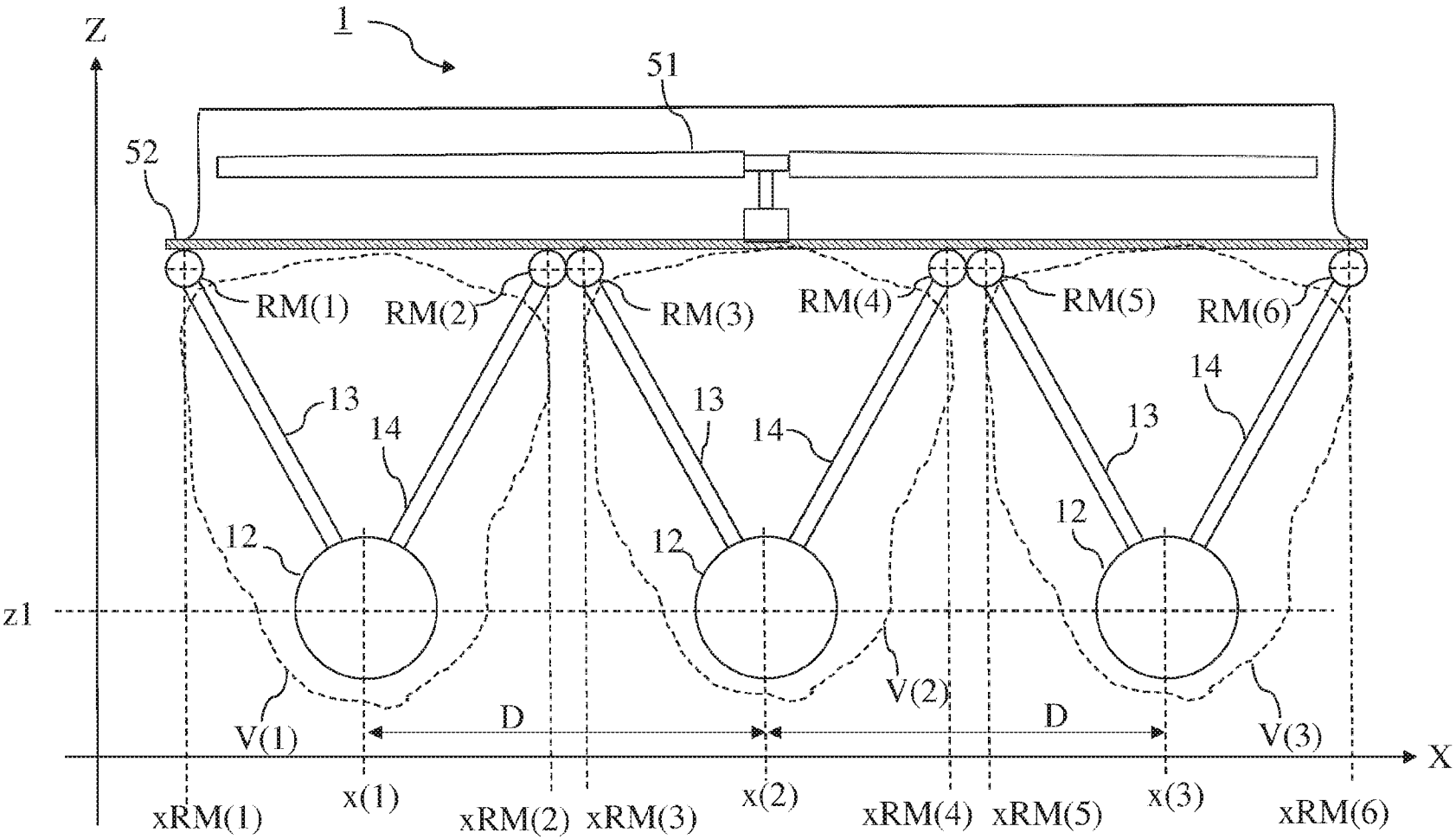
FIG. 5 shows a cross section of another example of an air-cooled condenser street comprising three rows of V-shaped heat exchangers.

Examples of air-cooled condenser streets according to the invention are shown in FIGS. 2 to 5. An air-cooled condenser street comprises a single-row or a series of adjacent rows V(i) of heat exchangers. In FIG. 2, a front view of a single-row air-cooled condenser street is shown, while FIG. 3 illustrates a front view of a two-row air-cooled condenser street. FIG. 4 and FIG. 5 illustrate a front view of a three-row air-cooled condenser street.

a. A front view of a V-shaped heat exchanger row v(i) is shown in FIG. 1. Such a V-shaped heat exchanger row V(i) comprises one or more first tube bundles 13 inclined with an angle $-\delta 1$ with respect to a vertical plane Z-Y, formed by a vertical axis Z and a longitudinal axis Y perpendicular to the vertical axis Z, with $15° < \delta 1 < 90°$. The V-shaped heat exchanger row further comprises one or more second tube bundles 14 inclined with an angle $+\delta 2$ with respect to the vertical plane, with $15° < \delta 2 < 90°$. Each V-shaped heat exchanger row comprises a main steam manifold 12 for supplying the exhaust steam to the first and second tube bundles. The main steam manifold 12 is extending in a direction parallel with the longitudinal axis Y and is positioned at a vertical position z1 with respect to said vertical axis Z and positioned at a lateral position x(i) with respect to a lateral axis X perpendicular to said axes Z and Y. The main steam manifold 12 is connected to the lower ends of the first 13 and second 14 tube bundles such that the main steam manifold can provide steam to both the first and the second tube bundles.

As illustrated in FIGS. 3 to 5, if the air-cooled condenser street comprises more than one row of V-shaped heat exchangers, the main steam manifolds are positioned at the same position z1 with respect to the vertical axis Z.

A tube bundle is known in the art and comprises a plurality of parallel oriented condensing tubes. A tube bundle can also be named a tube panel as the parallel tubes are forming a panel. The lower ends and upper ends of a tube bundle has to be construed as the lower and upper ends of the tubes of the tube bundle. Hence, a connection of the lower ends of the tube bundles to the main steam manifold has to be construed as a connection of the tubes of the tube bundles to the main steam manifold such that the steam can flow from the main steam manifold into the tube bundles.

As the heat exchangers according to the invention have a V-shape, the condensate formed in the first and second tube bundles will flow by gravitation to the main steam manifold. Preferably, the inclination angles of the tube bundles are as follows: $20° < \delta 1 < 35°$ and $20° < \delta 2 < 35°$.

These first 13 and second 14 tube bundles operate in a so-called counter flow mode where the steam and the condensate flow in opposite directions.

An example of a heat exchanger operating in counter flow mode is described in EP0346848 where two tube bundles are placed in a delta-shape geometry instead of a V-shape geometry and where two main steam manifolds are used per heat exchanger.

The air-cooled condenser street according to the invention further comprises a series of parallel top steam manifolds RM(j), with j=1 to NRM and $(NV+1) \leq NRM \leq (2*NV)$. The number NRM corresponds to the number of parallel top steam manifolds of the air-cooled condenser street. The parallel top steam manifolds RM(j) are configured for collecting and transporting non-condensable gases and/or steam that is not condensed in the first or second tube bundles. The series of parallel top steam manifolds are also extending in a direction parallel with the longitudinal axis Y. As illustrated in FIGS. 3 to 5, the parallel top steam manifolds are positioned at different positions xRM(j) with respect to the lateral axis X, with j=1 to NRM.

The axes X,Y,Z are forming an exemplary coordinate system, used to express the orientation or relative positions of some of the components of the air-cooled condenser street. Any other suitable coordinate system can be used as well to express these orientations and relative positions.

As further illustrated in FIGS. 2 to 5, the air-cooled condenser street is configured such that each tube bundle of the first 13 and second 14 tube bundles of the single-row or the series of rows of V-shaped heat exchangers is connected with its upper ends with a top steam manifold of the series of parallel top steam manifolds RM(j). In this way, each first tube bundle 13 and each second tube bundle 14 is connected with its lower ends to a main steam manifold and with its uppers ends with a top steam manifold. The air-cooled condenser street according to the invention comprises one or more fans 51 for inducing an air draft through the tube bundles of the single row or the series of adjacent rows of V-shaped heat exchangers. These fans are supported by fan support assemblies 50.

A fan support assembly 50 is configured for supporting one or more fans 51 and each fan support assembly 50 comprises a fan deck 52 configured for bridging the series of parallel top steam manifolds RM(j) in the direction of the lateral axis X. This is illustrated in FIG. 2 and FIG. 3 where the width W of the fan deck in the X-direction is shown to be sufficiently long such that fan deck is bridging all the parallel top steam manifolds of the air-cooled condenser street.

The fan deck 52 of the support assembly 50 is coupled to the top steam manifolds of the series of parallel top steam manifolds RM(j). In this way, the fan deck can rest on top of the series of parallel top steam manifolds as illustrated in FIGS. 2 to 5. Hence, the series of parallel top steam manifolds RM(i) are forming a support assembly for supporting the fan deck resting on the parallel top steam manifolds. Advantageously, there is no additional support structure needed to support the fan deck.

A fan deck that is coupled to the parallel top steam manifolds has to be construed as a fan deck that is joined to or resting on the parallel top steam manifolds. Details on how the coupling between the fan deck and the parallel top steam manifolds is performed will be discussed in more detail below.

As the fan deck is coupled to the parallel top steam manifolds the weight of the fan support assemblies and the fans and their motorization is supported by the V-shaped heat exchangers that are designed to support these weights.

The number NV of rows of heat exchangers of the air-cooled condenser street has no upper limit but it is preferably limited to a value of 6 in order to take into account a maximum limit for the size of the fan deck and the maximum size available for the fan that is supported by the fan deck. In FIG. 2, an example of air-cooled condenser street comprising a single-row heat exchanger V(1) is shown. The known prior art air-cooled condenser streets generally comprise a single-row V-shaped heat exchanger with a single main steam manifold. As mentioned above, the current invention comprises embodiments where the air-cooled condenser street comprises multiple rows of V-shaped heat exchangers placed adjacently to each other and wherein each row comprises its proper main stream manifold. When multiple rows of V-shaped heat exchangers are used, each main steam manifold 12 of each row of the V-shaped heat exchangers is located at the same vertical position z1 along the Z axis, as illustrated in FIGS. 3 to 5.

When the air-cooled condenser street comprises more than one row of V-shaped heat exchangers, the main steam manifolds 12 are generally separated by a distance D>1.5 m where D is measured along the lateral axis X. As shown on FIGS. 3 to 5, the distance D is measured between the centers of the main steam manifolds.

As mentioned above, the number NRM of parallel top steam manifolds RM(i) has a value in the range (NV+1) ≤NRM≤(2*NV). In FIG. 5, an example of an air-cooled condenser street having three rows of V-shaped heat exchangers and six parallel top steam manifolds is shown. In FIG. 4, an example of a configuration having three rows of V-shaped heat exchangers V(1), V(2) and V(3) and four parallel top steam manifolds RM(1), RM(2, RM(3) and RM (4) are presented. As shown in FIG. 3 and FIG. 4, a top steam manifold can be connected to two tube bundles of two different rows and hence form a common top steam manifold. The minimum number of parallel top steam manifolds needed is NV+1.

An exemplary fan support assembly 50 is schematically shown on FIG. 11. A fan support assembly 50 is a support structure configured for supporting one or more fans. The fan support assembly 50 comprises a fan deck 52 and a fan bridge 54 attached to the fan deck and configured for supporting a fan. Generally, a fan shroud 53, being a cylindrical element, is placed around the fan for guiding the direction of the air flow. In this example, shown on FIG. 11, the fan support assembly 50 is configured to support a single fan (the fan is not shown on FIG. 11) and hence comprises a single fan bridge 54. In some embodiments, the fan bridge comprises additional safety railings (not shown on the FIG. 11) to allow a safe access to the fan for maintenance purposes.

Figure 6:
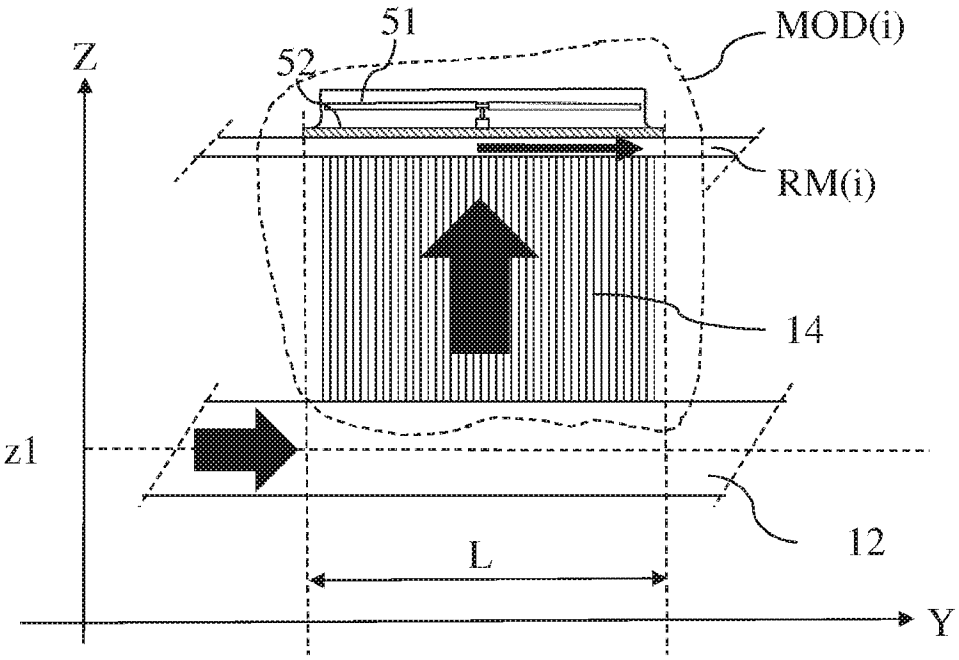
FIG. 6 shows a side view of an air cooled condenser module according to the invention.

The fan deck 52 is generally a square or rectangular platform having a circular opening for placing the fan. The fan deck comprises a number of supporting beams and cover panels (the cover panels are not shown on FIG. 11) configured such that the air flow will only flow through the circular opening. The fan shroud is located around the circular opening to guide the air flow. The width W along the lateral direction X of the fan deck is indicated on FIG. 2, FIG. 3 and FIG. 11 while the length L of the fan deck along the longitudinal direction Y is illustrated in FIG. 6 and FIG. 11. In the embodiment illustrated in FIG. 11, comprising a single fan, the fan deck has a rectangular outer shape and hence W=L. The fan deck and the fan bridge also provide for an access to the fans to perform maintenance activities.

In embodiments according to the invention, the air-cooled condenser street comprises multiple fan decks aligned in a direction parallel with the axis Y. For example, as illustrated in FIG. 7*b* and FIG. 9, three fan decks 52 are aligned along the Y direction.

As discussed above, the fan and the fan assembly together with the tube bundles is generally named a module and an air-cooled condenser street can hence be construed as a number of modules aligned along the Y axis. In FIG. 6, an example of one module MOD(i) of an air-cooled condenser street is shown. The black arrows in FIG. 6 indicate the flow of the steam and/or non-condensable gases. The steam flowing in the main steam manifold 12 enters the first and second tube bundles where the steam is condensed. The non-condensable gases or steam that is not condensed in the first or second tube bundles is collected and further transported by the top steam manifolds. In FIG. 9, a side view of an air-cooled condenser street with three modules MOD(i) is shown, wherein, in this example, each module comprises a fan 51, a fan deck and first and second tube bundles.

When steam starts to flow through the parallel top steam manifolds, the parallel top steam manifolds temperature increases from an ambient temperature to a temperature close to the steam temperature and hence the parallel top steam manifolds will thermally expand. As the fan deck is coupled to the parallel top steam manifolds, the temperature of the deck will also increase and hence the fan deck will also expand. To limit friction between the fan deck and the parallel top steam manifolds, the fan deck should preferably be placed on the manifolds in a way that the fan deck can freely expand.

In a preferred embodiment of the invention, the air-cooled condenser street comprises one or more guiding elements 71 located between the series of parallel top steam manifolds RM(i) and the fan deck. These guiding elements are configured such that the fan deck can freely move when the parallel top steam manifolds RM(i) and/or the fan deck is expanding due to temperature differences.

In one embodiment, the guiding elements comprise slotted holes. Preferably the slotted holes are placed at the extremities of the fan deck. In one preferred embodiment, in addition to the slotted holes, the fan deck is bolted at one location to one of the parallel top steam manifolds, so as to form a fixation point. Preferably, this fixation point is located in a center part of the fan deck. In this way, the fan deck is properly attached to the parallel top steam manifolds while providing the freedom to the fan deck to freely expand when there is a differential expansion between the fan deck and the parallel top steam manifolds. In FIG. 7*a* and FIG. 7*b*, the slotted holes 71 and a fixation point 72 are schematically represented.

In a preferred embodiment, the air-cooled condenser street according to the invention comprises one or more expansion openings or expansion joints to allow for free expansion in the Y direction of each fan deck aligned parallel with the axis Y. In FIG. 7*b* and FIG. 9, an illustration of expansion openings EO between multiple fan decks aligned along the axis Y are shown.

As mentioned above, condensate formed in the tube bundles will flow by gravitation to the main steam manifolds. Hence, each of the plurality of main steam manifolds 12 comprises a condensate section configured for collecting and evacuating condensate.

In a preferred embodiment, as illustrated in FIG. 3, the air-cooled condenser street comprises two rows of V-shaped heat exchangers V(1) and V(2). This preferred embodiment further comprises three parallel top steam manifolds RM(1), RM(2) and RM(3) and wherein RM(2) is located between RM(1) and RM(3). The top steam manifold RM(2) is forming a common top steam manifold connected with one tube bundle 14 of row V(1) and connected with one tube bundle 13 of row V(2).

The length along the longitudinal axis Y of the main steam manifolds can range between 10 m and 100 m. In view of this long length along the Y axis, the heat exchangers comprise generally a plurality of first tube bundles and a plurality of second tube bundles. For example, in FIG. 9, a side view of an air-cooled condenser street is shown having three first 13 and three second tube bundles 14. In practice, as discussed above, the length of the air-cooled condenser street along the Y axis is long and hence the number of first tube bundles and second tube bundles can be higher than shown in this example.

As known in the art, each tube bundle comprises a plurality of parallel oriented finned tubes. The finned tubes have a tube length TL in the range of 2 m≤TL≤12 m. The length TL of the tubes corresponds to the distance between the lower end and the upper end of the tube bundles as illustrated in FIG. 1.

In embodiments according to the invention, the tube bundles comprise state of the art single row tubes. The cross sections of these single row tubes can have for example a rectangular shape or alternatively an elliptical shape. In other embodiments, multiple layer round core tubes can be placed in parallel for forming the tube bundles.

The main steam manifolds of the rows V(i) of V-shaped heat exchangers are separated by a distance D, measured along the axis X, as for example shown on FIGS. 3 to 5. This distance D depends on the length of the tube bundles and the angle δ1+δ2 between the pair of tube bundles.

In an exemplary embodiment, the distance D between the main steam manifolds is between 5 m and 6 m, the angle δ1 is between 25° and 35°, the angle δ2 is between 25° and 35°, and the length of the tube bundles is between 4 m and 6 m.

The length of the first tube bundles and the length of the second tube bundles of the V-shaped heat exchanger is not necessary the same. For example, in FIG. 5, all the tube bundles have the same length while in the embodiment of FIG. 4, some tube bundles have a different length. The embodiments shown in FIG. 3 and FIG. 4 comprise common parallel top steam manifolds which have a diameter that is larger than the other parallel top steam manifolds. Therefore the tube bundles connected with the common parallel top steam manifolds have a shorter length. Preferably, the length of the tubes and the diameter of the parallel top steam manifolds are defined such that the top part of all the steam manifolds RM(i) are at the same height z2 to allow the fan deck to be easily supported by all the parallel top steam manifolds. This common height z2 for the top part of the parallel top steam manifolds is illustrated in FIG. 4.

The main steam manifold 12 according to the invention has to be construed as a duct that comprises an entrance side for receiving exhaust steam from a turbine and that is further configured to distribute this exhaust steam to the first and second tube bundles of the V-shaped heat exchanger. The main steam manifold has generally a tubular shape with a diameter between 0.4 m and 2.5 m at the entrance side. The diameter is generally not constant over the entire length along the Y axis direction, but the diameter is being reduced as function of the remaining number of tube bundles to be supplied with steam.

In operation, the exhaust steam is supplied to the tubes of first and second tube bundles at their lower ends, and when the steam condensates in the tubes of the first and second tube bundles, the condensate flows back to the main steam manifold. As mentioned above, this mode of operation is named counter-flow mode as the steam and condensate flow in an opposite direction. An example of a main steam manifold 12 that is configured to provide both functions of supplying steam to the tube bundles and collecting the condensate formed in the tube bundles is disclosed in EP0346848.

Generally, not all steam is condensed after a single passage through a tube of a tube bundle and hence there is non-condensed steam that exits the ends of the tubes and enters in the top steam manifold. In addition, non-condensable gases will also flow to the top steam manifold. The top steam manifold according to the invention has to be construed as a duct that is connected to the ends of first and second tube bundles to collect, transport and redistribute the non-condensed steam and the non-condensed gases. The top steam manifold has generally a tubular shape with a typical diameter between 0.2 m and 1.0 m. The top steam manifold is configured to redistribute these non-condensed steam and non-condensable gases to for example a further condensing system or to a system that will further separate steam from non-condensable gases.

The parallel top steam manifolds are not necessarily forming a continuous duct over the entire length along the Y axis of the air-cooled condenser street. The top steam manifold can for example be divided in a number of separate sections or separate tubes. The parallel top steam manifolds can also have different compartments depending on the detailed implementation of for example a multi-stage condensation mechanism.

In U.S. Pat. No. 7,096,666, an air-cooled condenser configuration having two air-cooled condenser streets is disclosed. In this configuration, the main steam manifolds are positioned below the heat exchangers for supplying steam to the lower ends of the tube bundles and parallel top steam manifolds are connected to the upper ends of the tube bundles. In this disclosure, the parallel top steam manifolds are arranged to additionally supply steam through the upper ends of tube bundles and a further mechanism is discussed to extract the non-condensable gases.

In a preferred embodiment according to the invention, each row V(i) of V-shaped heat exchangers further comprises one or more third tube bundles 15 inclined with said angle −61 (15°<δ1<90° with respect to said vertical plane (Z-Y), and one or more fourth tube bundles 16 inclined with said angle +δ2 (15°<δ2<90°) with respect to said vertical plane (Z-Y). This is schematically illustrated in FIG. 13*a* and FIG. 13*b* where a side view and a front view of an example of this preferred embodiment is shown. In this configuration, the third 15 tube bundles are connected with their uppers ends to the same top steam manifold as the first 13 tube bundles and the fourth 16 tube bundles are connected with their upper ends to the same top steam manifold as the second 14 tube bundles. The lower ends of the third 15 and fourth 16 tube bundles are connected with a supplementary steam manifold 85 configured for transporting non-condensable gases and/or steam that is not condensed in the third and fourth tube bundles.

The first and second tube bundles are generally named primary tube bundles and the third and fourth tube bundles are generally named secondary tube bundles. The primary tube bundles operate in the counter flow mode as discussed above, while the secondary tube bundles operate in a parallel flow mode where steam and condensate flows in the same direction. The black arrows on FIG. 13*a* indicate the flow of the steam and/or non-condensable gases.

When the air-cooled condenser is in operation, the exhaust steam enters the main steam manifold 12 where the steam is distributed to the lower ends of the first 13 and second 14 tube bundles (i.e. the primary tube bundles). Steam that is not condensed in the first bundle flows, together with non-condensable gases, to the top steam manifold that transports and supplies the remaining steam to the third tube bundles (i.e. secondary tube bundles). Similar, steam not condensed in the second tube bundles is collected in a top steam manifold and supplied to the fourth tube bundles for further condensation.

In alternative embodiments, the supplementary steam manifold 85 can be configured as a separate compartment of the main steam manifold 12.

In a preferred embodiment of the air-cooled condenser street according to the invention, as further schematically illustrated in FIG. 13*a* and FIG. 13*b*, each row V(i) of V-shaped heat exchangers further comprises one or more fifth tube bundles 17, each inclined with the angle $-\delta 1$ with respect to said vertical plane (Z-Y), with $15° < \delta 1 < 90°$, and one or more sixth tube bundles 18, each inclined with the angle $+\delta 2$ with respect to said vertical plane (Z-Y), with $15° < \delta 2 < 90°$. For each row V(i), the fifth and sixth tube bundles are connected with their lower ends to the supplementary steam manifold 85 for receiving non-condensable gases and steam that is not condensed in the third and/or fourth tube bundles. The fifth tube bundles 17 are connected with their upper ends to a first evacuation manifold 86 and the sixth tube bundles 18 are connected with their upper ends to a second evacuation manifold 87. These first and second evacuation manifolds are configured for evacuating non-condensable gases. The fifth and sixth tube bundles are also named tertiary tube bundles and also operate in a counter flow mode.

In the embodiments comprising primary, secondary and tertiary tube bundles, the air-cooled condenser streets are configured such that the majority of the exhaust steam is condensed in the primary tube bundles (i.e. 50% to 80%) and a further fraction is condensed in the secondary tube bundles. In the tertiary tube bundles, generally only a very small fraction of the total exhaust steam is condensed (<10%). As discussed in EP0346848, the use of a sequence of primary and secondary tube bundles can reduce the risk, in the winter period, of freezing of condensate in the tube bundles. This freezing is generally a consequence of a non-efficient evacuation of the non-condensable gases.

As shown in FIGS. 8 and 9, the air-cooled condenser street can be elevated in order to place the main steam manifolds 12 at a height H1 above a ground floor 65. This height H1 is typically between 4 m and 30 m. As the main steam manifolds 12 are located in the vertex region of the V-shaped heat exchangers, a simplified support structure can be provided to lift the main steam manifolds in the air.

In an embodiment according to the invention, as shown on FIG. 8 and FIG. 9, the support structure 60 to support the main steam manifolds 12 of an air-cooled condenser street comprises a plurality of concrete support columns 61 oriented in parallel with the axis Z and coupled on one end to the ground floor and coupled to the other end with the main steam manifold 12. In this example, no supporting steel constructions are necessary.

Generally, an air-cooled condenser does not comprise a single air-cooled condenser street but a plurality of air-cooled condenser streets placed next to each other. For example, in FIG. 12 an air-cooled condenser is schematically shown, comprising eight air-cooled condenser streets ACC(i) placed adjacently to each other. In this example, each air-cooled condenser street ACC(i) comprises seven modules MOD(j) aligned along the Y axis and each module comprises one fan deck 52 and one fan 51. Each air-cooled condenser street ACC(i) comprises two rows of V-shaped heat exchangers wherein each row of V-shaped heat exchangers comprises a main steam manifold 12. Hence, in total, in this example, the air-cooled condenser comprises 16 main steam manifolds 12 that are connected with a main steam duct supply 55 that supplies the exhaust steam from the turbine.

It is a further object of the invention to provide an air-cooled condenser that comprises a plurality of air-cooled condenser streets and a support structure 60 configured for elevating the plurality of air-cooled condenser streets at a height H1 above a floor level.

As illustrated in FIGS. 8 to 10, the height H1 is defined as the distance between the center of the steam manifold and the ground floor 65, as measured along the axis Z. In the example shown on FIGS. 8 and 9, the main steam manifolds of an air-cooled condenser street are elevated by using concrete support columns 61 connected on end to the main steam manifolds 12 and connected on the other end to the ground floor 65.

In FIG. 10, an example is shown of an air-cooled condenser comprising two air-cooled condenser streets ACC(1) and ACC(2). A support structure supporting both air-cooled condenser streets is provided. The support structure comprises two or more steel trusses 62 extending in a direction parallel with said axis X and configured for supporting the two air-cooled condenser streets. The steel trusses are supported by a plurality of concrete support columns 61. The support columns 61 are attached on one end to the support trusses and on the other end coupled to the ground floor 65. In this example, as shown on FIG. 10, each steel truss 62 is supported by two concrete support columns 61. With this support structure, the main steam manifolds 12 of each of the air-cooled condenser streets 1 are resting on two or more steel trusses 62. The number of steel trusses 62 needed to support the air-cooled condenser streets depends on the length along the Y axis of the main steam manifolds 12.

In alternative embodiments, no concrete columns are used as a support structure, instead, the support structure of the air-cooled condenser 3 comprises three or more separate steel support frames. In the example shown in FIG. 14, three steel support frames SF(i), with i=1 to 3, are supporting a plurality of steam manifolds 12. These three support frames have upper ends and lower ends and the lower ends are coupled to the ground floor 65 and the upper ends are coupled to the main steam manifolds 12 of the air-cooled condenser streets. The three separate steel support frames are extending in a direction parallel with the axis X and are positioned at different locations along the Y direction so as to support the main steam manifolds 12 of each of the air-cooled condenser streets 1 at three different locations of the parallel top steam manifolds.

Preferably, the support frame SF(2) that is located in between SF(1) and SF(2) has a fixed connection with the main steam manifolds 12 and with the ground floor 65 while the support frames SF(1) and SF(3) have a moveable connection with the main steam manifolds 12 and with the ground floor. The moveable connection is realized by using for example a hinge assembly 95 at the lower and upper end of the support frame. In this way, the hinges allow the steam manifold to expand when there are thermal differences. The arrows shown on top of the main steam manifold in FIG. 14 indicate the direction of potential expansion of the main steam manifold.

In embodiments according to the invention, the single-row or the series of rows of adjacent V-shaped heat exchangers of the air-cooled condenser street are forming a self-supporting structure configured for supporting the weight of the one or more fan support assemblies 50 and the one or more fans 51. As illustrated in FIGS. 8 to 10, the rows of V-shaped heat exchangers support the fan deck and the equipment mounted on the fan deck such as the fan and the motorization of the fan without the need of any additional support structure.

In alternative embodiments, some additional support beams 68 can be added to increase the rigidity of the V-shaped heat exchangers. For example, as shown on FIG. 15, some additional support beams 68 can be attached to the top steam manifolds that are located at the outer sides of the air-cooled heat exchanger street. For example, one end of the support beam can be attached to a top steam manifold and the other end can be attached to the lower level support structure. These additional support beams 68 only represent a small additional amount of steel to be used when compared to prior art devices where an entire support structure is built to support the fans. With the current embodiments of the invention, advantage is taken from the support capacity of the V-shaped heat exchangers by coupling the fan deck to the top steam manifolds.

The present invention has been described in terms of specific embodiments, which are illustrative of the invention and not to be construed as limiting. More generally, it will be appreciated by persons skilled in the art that the present invention is not limited by what has been particularly shown and/or described hereinabove. The invention resides in each and every novel characteristic feature and each and every combination of characteristic features. Reference numerals in the claims do not limit their protective scope. Use of the verbs "to comprise", "to include", "to be composed of", or any other variant, as well as their respective conjugations, does not exclude the presence of elements other than those stated. Use of the article "a", "an" or "the" preceding an element does not exclude the presence of a plurality of such elements.

The invention claimed is:

1. An air-cooled condenser street for condensing exhaust steam from a turbine comprising:

a single-row or a series of adjacent rows V(i) of V-shaped heat exchangers, with i=1 to NV and NV≥1, NV being the number of rows of V-shaped heat exchangers, and wherein the single-row or each row of the series of adjacent rows includes:

one or more first tube bundles inclined with an angle −δ1 with respect to a vertical plane (Z-Y), formed by a vertical axis Z and a longitudinal axis Y perpendicular to the vertical axis Z, with 15°<δ1<90°, one or more second tube bundles inclined with an angle +δ2 with respect to said vertical plane, with 15°<δ2<90°, and wherein said first and second tube bundles have lower ends and upper ends, and a main steam manifold for supplying the exhaust steam to the first and second tube bundles, said main steam manifold:

extending in a direction parallel with said longitudinal axis Y, positioned at a vertical position z1 with respect to said vertical axis Z, positioned at a lateral position x(i) with respect to a lateral axis X perpendicular to said axes Z and Y, and connected to the lower ends of the first and second tube bundles;

one or more fans for inducing an air draft through the single row or the series of adjacent rows of V-shaped heat exchangers;

a series of parallel top steam manifolds RM(j) for collecting and transporting non-condensable gases and/or steam that is not condensed in the first or second tube bundles, with j=1 to NRM and (NV+1)≤NRM≤(2*NV), and with NRM being the number of parallel top steam manifolds, and wherein each top steam manifold RM(j) of said series of parallel top steam manifolds is extending in a direction parallel with said longitudinal axis Y, and wherein said air-cooled condenser street is configured such that each tube bundle of the first and second tube bundles of said single-row or said series of adjacent rows is connected with its upper ends with a top steam manifold of said series of parallel top steam manifolds RM(j);

one or more fan support assemblies for supporting the one or more fans, and wherein each fan support assembly includes a fan deck configured for bridging said series of parallel top steam manifolds RM(j) in the direction of said lateral axis X, and wherein said fan deck is coupled to said series of parallel top steam manifolds RM(j); and one or more guiding elements located between said fan deck and said series of parallel top steam manifolds RM(j), said one or more guiding elements are configured to allow a differential thermal expansion between the fan deck and the parallel top steam manifolds RM(j).

2. An air-cooled condenser street according to claim 1 wherein said one or more guiding elements comprise one or more slotted holes.

3. An air-cooled condenser street according to claim 1, wherein each main steam manifold of said single-row or said series of adjacent rows of V-shaped heat exchangers comprises a condensate section configured for collecting and evacuating condensate.

4. An air-cooled condenser street according to claim 1, wherein said first and second tube bundles comprise a plurality of parallel oriented finned tubes and wherein said finned tubes have a tube length TL in the range of 2 m≤TL≤12 m.

5. An air-cooled condenser street according to claim 1, wherein adjacent fan decks are separated by an expansion opening EO to allow for thermal expansion in a direction parallel with said axis Y.

6. An air-cooled condenser street according to claim 1, wherein the single-row or the series of adjacent rows of V-shaped heat exchangers are forming a self-supporting structure configured for supporting the weight of said one or more fan support assemblies and said one or more fans.

7. An air-cooled condenser street according to claim 1, wherein a distance D between two adjacent main steam manifolds is larger than 1.5 m.

8. An air-cooled condenser street according to claim 1, wherein said number of rows of V-shaped heat exchangers NV is equal to two and said number of parallel top steam manifolds NRM is equal to three, and wherein the top steam manifold RM(2) located between the top steam manifolds RM(1) and RM(3) is a common top steam manifold connected with the second tube bundles of the heat exchanger V(1) and connected with the first tube bundles of the heat exchanger V(2).

9. An air-cooled condenser comprising:

one or more air-cooled condenser streets according to claim 1, and a support structure configured for elevating the main steam manifolds of each of the one or more air-cooled condenser streets at a height H1>4 m with respect to a ground floor and wherein H1 is measured along said vertical axis Z.

10. An air-cooled condenser street for condensing exhaust steam from a turbine comprising:

a single-row or a series of adjacent rows V(i) of V-shaped heat exchangers, with i=1 to NV and NV≥1, NV being the number of rows of V-shaped heat exchangers, and wherein the single-row or each row of the series of adjacent rows includes:

one or more first tube bundles inclined with an angle −δ1 with respect to a vertical plane (Z-Y), formed by a vertical axis Z and a longitudinal axis Y perpendicular to the vertical axis Z, with 15°<δ1<90°, one or more second tube bundles inclined with an angle +δ2 with respect to said vertical plane, with 15°<δ2<90°, and wherein said first and second tube bundles have lower ends and upper ends, a main steam manifold for supplying the exhaust steam to the first and second tube bundles, said main steam manifold:

extending in a direction parallel with said longitudinal axis Y, positioned at a vertical position z1 with respect to said vertical axis Z, positioned at a lateral position x(i) with respect to a lateral axis X perpendicular to said axes Z and Y, and connected to the lower ends of the first and second tube bundles;

one or more third tube bundles inclined with said angle −δ1 with respect to said vertical plane (Z-Y) and connected with their upper ends to the same top steam manifold as the first tube bundles, one or more fourth tube bundles inclined with said angle +δ2 with respect to said vertical plane (Z-Y) and connected with their upper ends to the same top steam manifold as the second tube bundles, and a supplementary steam manifold configured for transporting non-condensable gases and/or steam that is not condensed in the third and fourth tube bundles, and wherein the supplementary steam manifold is connected with the lower ends of said third and fourth tube bundles;

one or more fans for inducing an air draft through the single row or the series of adjacent rows of V-shaped heat exchangers;

a series of parallel top steam manifolds RM(j) for collecting and transporting non-condensable gases and/or steam that is not condensed in the first or second tube bundles, with j=1 to NRM and (NV+1)≤NRM≤(2*NV), and with NRM being the number of parallel top steam manifolds, and wherein each top steam manifold RM(j) of said series of parallel top steam manifolds is extending in a direction parallel with said longitudinal axis Y, and wherein said air-cooled condenser street is configured such that each tube bundle of the first and second tube bundles of said single-row or said series of adjacent rows is connected with its upper ends with a top steam manifold of said series of parallel top steam manifolds RM(j), and one or more fan support assemblies for supporting the one or more fans, and wherein each fan support assembly includes a fan deck configured for bridging said series of parallel top steam manifolds RM(j) in the direction of said lateral axis X, and wherein said fan deck is coupled to said series of parallel top steam manifolds RM(j).

11. An air-cooled condenser street according to claim 10 wherein the single-row or each row of the series of adjacent rows of V-shaped heat exchangers further comprises:

one or more fifth tube bundles inclined with said angle −δ1 with respect to said vertical plane (Z-Y), and said fifth tube bundles are connected with their upper ends to a first evacuation manifold configured for evacuating non-condensable gases; and one or more sixth tube bundles inclined with said angle +δ2 with respect to said vertical plane (Z-Y), and said sixth tube bundles are connected with their upper ends to a second evacuation manifold configured for evacuating non-condensable gases, and wherein said fifth and said sixth tube bundles are connected with their lower ends to said supplementary steam manifold for receiving non-condensable gases and steam that is not condensed in the third and/or fourth tube bundles.

12. An air-cooled condenser according to claim 9, wherein said support structure comprises a plurality of concrete support columns oriented in parallel with said vertical axis Z and coupled on one end to the ground floor and coupled to the other end with the main steam manifolds.

13. An air-cooled condenser according to claim 9, wherein said support structure comprises:

two or more steel trusses extending in a direction parallel with said lateral axis X, and a plurality of concrete support columns coupled on one end to the steel trusses and coupled on the other end to the ground floor so as to elevate the steel trusses from the ground floor, wherein the main steam manifolds of each of the air-cooled condenser streets are resting on said two or more steel trusses.

14. An air-cooled condenser according to claim 9, wherein said support structure comprises three or more separate steel support frames SF(i) extending in a direction parallel with said lateral axis X and positioned at different locations in a direction parallel with the longitudinal axis Y, so as to support the main steam manifolds of each of the air-cooled condenser streets at three or more different locations along the main steam manifolds.

* * * * *